US009267383B2

(12) United States Patent
Batt et al.

(10) Patent No.: US 9,267,383 B2
(45) Date of Patent: Feb. 23, 2016

(54) TURBINE AIRFOIL

(75) Inventors: Stephen Batt, Lincoln (GB); Jonathan Mugglestone, South Normanton (GB); Li Shing Wong, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 496 days.

(21) Appl. No.: 13/576,675

(22) PCT Filed: Feb. 15, 2011

(86) PCT No.: PCT/EP2011/052169
§ 371 (c)(1), (2), (4) Date: Oct. 22, 2012

(87) PCT Pub. No.: WO2011/101322
PCT Pub. Date: Aug. 25, 2011

(65) Prior Publication Data

US 2013/0058787 A1 Mar. 7, 2013

(30) Foreign Application Priority Data

Feb. 19, 2010 (EP) ..... 10154125

(51) Int. Cl.
*F01D 5/28* (2006.01)
*F01D 5/18* (2006.01)

(52) U.S. Cl.
CPC ..... *F01D 5/288* (2013.01); *F01D 5/286* (2013.01); *F01D 5/186* (2013.01); *F05D 2230/90* (2013.01); *F05D 2250/713* (2013.01); *F05D 2260/95* (2013.01)

(58) Field of Classification Search
CPC ..... F01D 5/288; F01D 5/286; F01D 25/007; F01D 9/02; F01D 9/04; F01D 9/041; F01D 9/06; F01D 5/186; F01D 5/187; F05D 2250/713; F05D 2230/90; F05D 2260/95
USPC ..... 416/95, 96 R, 96 A, 97 R, 224, 229 R, 416/229 A, 241 R, 241 B, 232, 233; 415/115, 415/178, 200
See application file for complete search history.

(56) References Cited

U.S. PATENT DOCUMENTS 3,796,513 A * 3/1974 Jonas ..... 416/224
4,121,894 A 10/1978 Bernardo
(Continued)

FOREIGN PATENT DOCUMENTS

EP 1245786 A2 10/2002
EP 1544414 A1 6/2005
(Continued)

*Primary Examiner* — Christopher Verdier

(57) ABSTRACT

A turbine airfoil includes an airfoil body with a leading edge, trailing edge, and an exterior surface including a suction side and a pressure side located opposite to the suction side. The exterior surface shows away from the interior of the airfoil body. A thermal barrier coating system is present on the exterior surface of the airfoil body in a coated surface region. The airfoil also includes an uncoated surface region where a thermal barrier coating system is not present. The uncoated region extends on the suction side of the exterior surface from the trailing edge towards the leading edge to a boundary line between the coated surface region and the uncoated surface region, wherein the boundary line is located on the suction side between the leading edge and the trailing edge. The airfoil body also includes a step in the exterior surface extending along the boundary line.

12 Claims, 1 Drawing Sheet

(56) References Cited

U.S. PATENT DOCUMENTS

| | | | | |
|---|---|---|---|---|
| 5,209,645 | A * | 5/1993 | Kojima et al. | 416/241 B |
| 6,077,036 | A | 6/2000 | Carson | |
| 6,126,400 | A | 10/2000 | Nichols | |
| 6,461,108 | B1 * | 10/2002 | Lee et al. | 416/96 R |
| 2002/0141870 | A1 | 10/2002 | Darolia | |
| 2003/0118444 | A1 * | 6/2003 | Lee et al. | 416/97 R |
| 2007/0148003 | A1 | 6/2007 | Vassiliev | |
| 2008/0152858 | A1 * | 6/2008 | Schreiber | 428/68 |
| 2009/0003988 | A1 | 1/2009 | Campbell | |
| 2009/0043340 | A1 | 2/2009 | Lowry | |
| 2009/0104356 | A1 | 4/2009 | Marszal | |
| 2009/0194356 | A1 | 8/2009 | Kato | |

FOREIGN PATENT DOCUMENTS

| | | | |
|---|---|---|---|
| RU | 2317420 | C1 | 2/2008 |
| SU | 823604 | A1 | 4/1981 |
| WO | WO 9810174 | A1 | 3/1998 |
| WO | WO 2005108746 | A1 | 11/2005 |
| WO | WO 2008043340 | A1 | 4/2008 |

* cited by examiner

TURBINE AIRFOIL

CROSS REFERENCE TO RELATED APPLICATIONS

This application is the US National Stage of International Application No. PCT/EP2011/052169, filed Feb. 15, 2011 and claims the benefit thereof. The International Application claims the benefits of European application No. 10154125.8 EP filed Feb. 19, 2010. All of the applications are incorporated by reference herein in their entirety.

FIELD OF INVENTION

The present invention relates to a turbine airfoil which can be used in a gas turbine vane or blade.

BACKGROUND OF INVENTION

The airfoils of gas turbines are typically made of nickel or cobalt based superalloys which show high resistance against the hot and corrosive combustion gases present in gas turbine. However, although such superalloys have considerably high corrosion and oxidation resistance, the high temperatures of the combustion gases in gas turbines require measures to improve corrosion and/or oxidation resistance further. Therefore, airfoils of gas turbine blades and vanes are typically at least partially coated with a thermal barrier coating system to prolong the resistance against the hot and corrosive environment. In addition, airfoil bodies are typically hollow so as to allow a cooling fluid, typically bleed air from the compressor, to flow through the airfoil. Cooling holes present in the walls of the airfoil bodies allow a certain amount of cooling air to exit the internal passages so as to form a cooling film over the airfoil surface which further protects the superalloy material and the coating applied thereon from the hot and corrosive environment. In particular, cooling holes are present at the trailing edges of the airfoils as it is shown in U.S. Pat. No. 6,077,036, U.S. Pat. No. 6,126,400, US 2009/0194356 A1 and WO 98/10174, for example.

Trailing edge losses are a significant fraction of the over all losses of a turbomachinery blading. In particular, thick trailing edges result in higher losses. For this reason, cooled airfoils with a cutback design at the trailing edge have been developed. This design is realised by taking away material on the pressure side of the airfoil from the trailing edge up to several millimeters towards the leading edge. This measure provides very thin trailing edges which can provide big improvements on the blading efficiency. An airfoil with a cutback design and a thermal barrier coating is, for example, disclosed in WO 98/10174 A1. However, the beneficial effect on the efficiency can only be achieved if the thickness of the trailing edge is rather small. On the other hand for a blade with thermal barrier coating, the combined thickness of the cast airfoil body wall and the applied thermal barrier coating system exceeds the optimum thickness of the design. In addition, as the flow velocity of the gas is the greatest at the trailing edge of the airfoil a thermal barrier coating applied to the trailing edge is prone to high levels of erosion.

It is known to selectively provide a thermal barrier coating system to the airfoil, in particular such that the trailing edge of an airfoil and adjacent regions of an airfoil remain uncoated. Selective coatings are, for example, described in U.S. Pat. No. 6,126,400, U.S. Pat. No. 6,077,036 and, with respect to the coating method, in US 2009/0104356 A1.

However, in U.S. Pat. No. 6,077,036 the pressure side of the airfoil is completely uncoated which means that areas which would not suffer from a higher combined thickness of the cast airfoil body and the coating applied thereon remain unprotected against the temperature the hot combustion gas.

WO 2008/043340 A1 describes a turbine airfoil with a thermal barrier coating the thickness of which varies over the airfoil surface. However, like in WO 98/10174 the trailing edge is fully coated so that the beneficial effect on blading efficiency can not be achieved. In U.S. Pat. No. 6,126,400 the thermal barrier coating only covers about half the airfoil, as seen from the leading edge towards the trailing edge.

In US 2009/0104356 A1 the method of masking the trailing edge will produce a step in the coating which adversely affects the aerodynamics of the blade.

SUMMARY OF INVENTION

With respect to the mentioned prior art it is an objective of the present invention to provide an improved airfoil and an improved turbine blade or vane.

These objectives are solved by the features of the independent claims. The depending claims contain further developments of the invention.

An inventive turbine airfoil for a turbine comprises a hollow airfoil body with a leading edge, a trailing edge and an exterior surface. The hollow airfoil body extends in a radial direction with respect to a rotational axis of the turbine. The exterior surface includes a suction side extending from the leading edge to the trailing edge and a pressure side extending from the leading edge to the trailing edge and being located opposite to the suction side on the airfoil body. The turbine airfoil further comprises a thermal barrier coating system present in a coated surface region, and an uncoated surface region where a thermal barrier coating system is not present. This uncoated surface region extends on the suction side from the trailing edge towards the leading edge to a boundary line located on the suction side between the leading edge and the trailing edge, in particular closer to the trailing edge than to the leading edge. In the illustrated embodiments, the boundary line mainly extends in the radial direction. The airfoil body comprises a step in the exterior surface. This step extends along the boundary line. In particular, the step may be formed such that the surface of the uncoated surface region lies higher than the surface of the cast airfoil body in the coated surface region. The height of the step is preferably equal to the thickness of the thermal barrier coating system.

"Higher" is meant in a sense that, in relation to a point or a plane located inside of the airfoil, a "higher" exterior surface has a larger distance to the point or plane than a second exterior surface. As a result, the surface which is not higher could be considered as a depression in comparison to the "higher" surface.

The present invention allows to produce very thin trailing edges without thermal barrier coating systems applied thereon and at the same time minimizing or even avoiding a step at the boundary between the coated surface region and the uncoated surface region. This step is minimized or avoided by providing the mentioned step in the surface of the airfoil body. By choosing the height of the step such that it matches the thickness of the thermal barrier coating system to be applied to form the coated surface region the surface of the applied coating in the coated region can be made to match the surface of the uncoated surface region. This allows to produce a finished surface of the partly coated airfoil which matches the designed definition in the coated surface region as well as in the uncoated surface region. Moreover, since there is no thermal barrier coating at the trailing edge an adverse effect on the airfoil lifetime due to high levels of erosion of the thermal barrier coating at the trailing edge does not occur.

The thermal barrier coating system may, in particular, comprise a thermal barrier coating and a bond coat located between the thermal barrier coating and the exterior surface of the airfoil body. Typical bond coats are aluminium oxide forming materials, in particular, so called MCrAlY-coatings, where M stands for cobalt and/or nickel, Cr stands for chromium, Al stands for aluminium, and Y stands for yttrium and/or one or more rare earth elements. In case of a coating system including a bond coat the height of the step preferably corresponds to the combined thickness of the bond coat and the thermal barrier coating.

Furthermore, the inventive turbine airfoil is preferably hollow and comprises at least one cooling opening, in particular realised by a cutback design, at the trailing edge. In this way, the trailing edge can be made particularly thin, if the hollow airfoil body comprises a wall the thickness of which is less in the uncoated surface region than in the coated surface region. The thickness of the wall region can, in particular, decrease over a small transition region on one or both sides of the boundary line. This avoids having a step at the inner surface of the airfoil body at or close to the location of the step in the outer surface.

An inventive turbine blade, which in particular is a gas turbine vane or blade, comprises an inventive turbine airfoil. The use of an inventive airfoil allows for producing highly efficient turbomachinery bladings.

BRIEF DESCRIPTION OF THE DRAWINGS

Further features, properties and advantages of the present invention will become clear from the following description of an embodiment in conjunction with the accompanying drawings.

DETAILED DESCRIPTION OF INVENTION

An inventive turbine airfoil may be part of a turbine blade or a turbine vane. Turbine blades are fixed to a rotor of the turbine and rotate together with the rotor. They are adapted for receiving momentum from the flowing combustion gas produced by a combustion system. The turbine vanes are fixed to the turbine casing and form nozzles for guiding on the combustion gases so as to optimize the momentum transfer to the rotor blades. The inventive turbine airfoil can, in general, be used in turbine blades as well as in turbine vanes.

Figure 1:
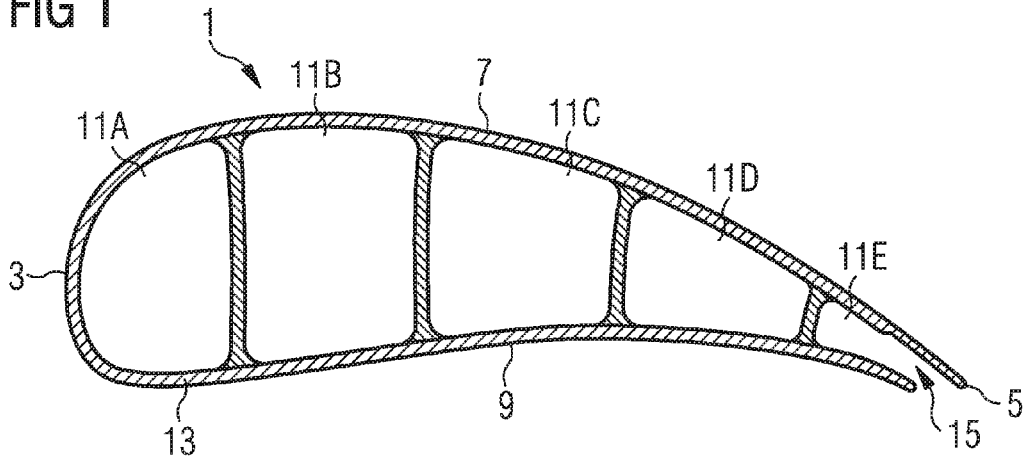
FIG. 1 schematically shows the structure of the inventive airfoil.

An inventive airfoil 1 is shown in FIG. 1. It comprises a cast airfoil body 13, a leading edge 3 at which the flowing combustion gases arrive at the airfoil 1—the leading edge 3 being the upstream edge—and a trailing edge 5 at which the combustion gases leave the airfoil 1—the trailing edge 5 being the downstream edge. The exterior surface of the airfoil 1 is formed by a convex suction side 7 and a less convex, and typically concave, pressure side 9 which is formed opposite to the suction side 7. Both the suction side 7 and the pressure side 9 extend from the leading edge 3 to the trailing edge 5.

The airfoil body 13 is hollow and comprises, in the present embodiment, a number of interior cavities 11A to 11E to allow a cooling fluid, typically bleed air from a compressor of the turbine engine, to flow there through and to cool the airfoil body 13. Moreover, a certain amount of cooling fluid is allowed to leave the internal cavities 11A to 11E through cooling holes present in the wall of the airfoil body 13 towards its exterior surface so as to form a cooling fluid film over the surface. Note that the cooling holes connecting the interior cavities 11A to 11D with the outside of the airfoil body 13 are not shown in the Figures. The internal cavity 11E which is closest to the trailing edge 5 comprises a slit 15 which allows cooling fluid to leave this cavity close to the trailing edge 5. The slit 15 is formed by a cut back in the pressure side 9 of the airfoil 1. This may be done to reduce losses due to a blockage at the trailing edge 5 and, hence, to increase efficiency of the turbomachinery bladings. The loss reducing effect is caused by the decreased thickness of the trailing edge due to the cutback design.

Figure 2:
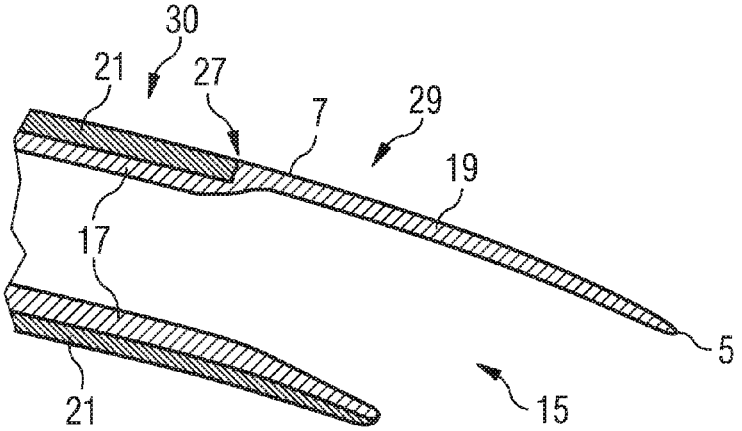
FIG. 2 shows the trailing edge of the airfoil shown in FIG. 1.

In order to reduce the thickness of the trailing edge 5 further, the thickness of the wall 17 of the airfoil body 13 is reduced at the suction side 7 of the airfoil in a region adjoining the trailing edge 5, as it is best seen in FIG. 2. FIG. 2 shows the trailing edge 5 of the airfoil 1 and adjacent airfoil regions. It can be seen that the suction side 7 comprises a thin airfoil region 19 which extends from the trailing edge 5 over a certain length of the airfoil profile towards the leading edge 3.

Figure 3:
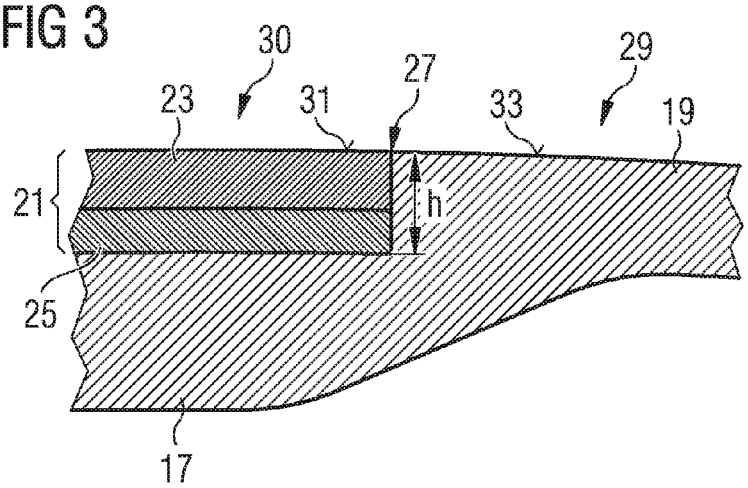
FIG. 3 shows a detail of FIG. 2.

The airfoil body 13 is cast from a high temperature resistive nickel based or cobalt based superalloy and covered with a thermal barrier coating system which reduces corrosion of the airfoil body 13 which would occur due to the hot and corrosive combustion gases flowing along the airfoil 1 in operation of a gas turbine. The thermal barrier coating system 21 is best seen in FIG. 3 which shows a detail of FIG. 2 in the transition region between the regular airfoil body wall 17 and the thin airfoil region 19. The thermal barrier coating system 21 comprises the actual thermal barrier coating 23, for example zirconium oxide which is at least partially stabilized by yttrium oxide, and a bond coat 25 located between the surface of the superalloy material the airfoil body 13 is made of and the thermal barrier coating 23. The bond coat is typically an aluminium oxide forming material, in particular an MCrAlY-coating.

A certain minimum wall thickness of the airfoil body wall 17 is necessary for applying such a thermal barrier coating system 21 to the airfoil body 13 so that a coated wall is characterized by a minimum thickness. This minimum thickness is, however, thicker than the desired thickness of the thin airfoil region 19. Therefore, no thermal barrier coating system 21 is applied to the thin airfoil region 19 so that the thin airfoil region 19 coincides with an uncoated airfoil region 29 which extends from the trailing edge 5 to a boundary line located between the trailing edge 5 and the leading edge 3, in particular closer to the trailing edge 5 than to the leading edge 3. Typically, the uncoated surface region does not extend over more than 10 to 30% of the distance between the trailing edge 5 and the leading edge 3. However, the exact distance over which the uncoated surface region 29 extends depends on the actual airfoil design.

According to the embodiment of FIG. 2, the uncoated surface region is only present on the suction side 7 and close to the trailing edge 5.

The boundary line is defined by a step 27 in the exterior surface of the cast airfoil body 13. In the present embodiment, the height h of the step 27 corresponds to the thickness of the thermal barrier coating system 21 and is designed such that the surface 33 of the thin airfoil region 19 lies higher than the surface 28 of the airfoil body 13 in the surface region to become coated.

Before the thermal barrier coating system 21 is applied to the surface of the cast airfoil body 13 the suction side 7 is masked between the step 27 and the trailing edge 5 to prevent coating material from adhering to the thin airfoil region 19 which shall become the uncoated airfoil region 29. After the thermal barrier coating system 21 has been applied to the exterior surface of the cast airfoil body 13 and the mask has been removed the surface 31 of the uncoated surface region, the surface of the thermal barrier coating system 21 is smoothly aligned with the surface 33 of the uncoated surface region 29. Hence, no step which could lead to losses is present between the coated surface region 30 and the uncoated surface region 29 of the airfoil suction side 7. In addition, as the thin airfoil region 19 between the boundary line and the trailing edge 5 is free from thermal barrier coating not only a very thin trailing edge 5 is achieved but also erosion of the coating due to the high velocities of the combustion gases at the trailing edge 5 are avoided.

To avoid a weak area in the wall 17 of the airfoil body 13 the transition between the regular airfoil body wall 17 and the thin airfoil region 19 is not realised in form of a step but in form of a region in which the thickness of the regular wall 17 gradually decreases from the normal thickness to the thickness of the thin airfoil region 19. In this context, please note that the thickness of the thermal barrier coating system 21 and, hence, the height h of the step 27, is exaggerated in the Figures in order to increase its visibility.

The invention has been described with reference to an exemplary embodiment of the invention for illustration purposes. However, deviations from the shown embodiment are possible. For example, additional uncoated surface regions may be present on the suction side and/or the pressure side of the airfoil. In addition, the thermal barrier coating system may deviate from the thermal barrier coating system used in the described embodiment. Furthermore, although the described airfoil has five internal cavities for allowing cooling fluid to flow there through the number of internal cavities may be larger or smaller than five.

The invention claimed is:

1. A turbine airfoil for a turbine having a rotational axis, the turbine airfoil comprising:

a hollow airfoil body extending in a radial direction with respect to the rotational axis, comprising:

a leading edge, a trailing edge, and an exterior surface including a suction side extending from the leading edge to the trailing edge and a pressure side extending from the leading edge to the trailing edge and being located opposite to the suction side on the airfoil body, wherein the exterior surface is the surface of an airfoil body wall that faces away from the interior of the airfoil body, a thermal barrier coating system present on the exterior surface of the airfoil body in a coated surface region, and an uncoated surface region where a thermal barrier coating system is not present, the uncoated surface region extending on the suction side of the exterior surface of said airfoil body from the trailing edge towards the leading edge to a boundary line between the coated surface region and the uncoated surface region, wherein the boundary line is located on said suction side between the leading edge and the trailing edge, wherein the airfoil body further comprises a step in the exterior surface extending along the boundary line, wherein the boundary line mainly extends in the radial direction, and wherein the hollow airfoil body comprises the airfoil body wall, the thickness of the airfoil body wall being less in the uncoated surface region than in the coated surface region.

2. The turbine airfoil as claimed in claim 1, wherein the step is formed such that the surface of the uncoated surface region lies higher than the surface of the airfoil body in the coated surface region so that the exterior surface of the airfoil body in the coated surface region forms a depression in comparison to the external surface of the airfoil body in the uncoated surface region.

3. The turbine airfoil as claimed in claim 2, wherein the height of the step is equal to the thickness of the thermal barrier coating system.

4. The turbine airfoil as claimed in claim 1, wherein the thermal barrier coating system comprises a thermal barrier coating and a bond coat located between the thermal barrier coating and the exterior surface of the airfoil body.

5. The turbine airfoil as claimed in claim 1, wherein the boundary line is closer to the trailing edge than to the leading edge.

6. The turbine airfoil as claimed in claim 1, wherein at least one cooling opening is present at the trailing edge.

7. The turbine airfoil as claimed in claim 6, wherein the thickness of the wall gradually decreases over a small region on one or both sides of the boundary line.

8. A turbine vane or blade comprising a turbine airfoil according to claim 1.

9. The turbine airfoil as claimed in claim 1, wherein the uncoated surface region is only present on the suction side of the exterior surface of the airfoil body, extending from the trailing edge to the boundary line.

10. The turbine airfoil as claimed in claim 1, the uncoated surface region does not extend over more than 10 to 30% of the distance between the trailing edge and the leading edge.

11. The turbine airfoil as claimed in claim 1, wherein the surface of the thermal barrier coating system is smoothly aligned with the surface of the uncoated surface region.

12. A turbine airfoil for a turbine having a rotational axis, the turbine airfoil comprising:

a hollow airfoil body extending in a radial direction with respect to the rotational axis, comprising:

a leading edge, a trailing edge, and an exterior surface including a suction side extending from the leading edge to the trailing edge and a pressure side extending from the leading edge to the trailing edge and being located opposite to the suction side on the airfoil body, wherein the exterior surface is the surface of an airfoil body wall that faces away from the interior of the airfoil body, a thermal barrier coating system present on the exterior surface of the airfoil body in a coated surface region, and an uncoated surface region where a thermal barrier coating system is not present, the uncoated surface region extending on the suction side of the exterior surface of said airfoil body from the trailing edge towards the leading edge to a boundary line between the coated surface region and the uncoated surface region, wherein the boundary line is located on said suction side between the leading edge and the trailing edge, wherein the airfoil body further comprises a step in the exterior surface extending along the boundary line, wherein the boundary line mainly extends in the radial direction, and wherein the hollow airfoil body comprises the airfoil body wall, the thickness of the airfoil body wall being less in the uncoated surface region than in the coated surface region, wherein the uncoated surface region is only present on the suction side of the exterior surface of the airfoil body, extending from the trailing edge to the boundary line.

* * * * *